United States Patent [19]

Davi et al.

[11] Patent Number: 4,906,057

[45] Date of Patent: Mar. 6, 1990

[54] CLOSED PORTABLE CARD FILE

[75] Inventors: Richard A. Davi, Glenwood; Hildaur L. Neilsen, Metuchen, both of N.J.

[73] Assignee: Rolodex Corporation, Secaucus, N.J.

[21] Appl. No.: 550,959

[22] Filed: Nov. 10, 1983

[51] Int. Cl.[4] ..... A47B 63/00

[52] U.S. Cl. ..... 312/193; 312/183; 312/244; 206/425

[58] Field of Search ..... 312/183, 193, 189, 244, 312/191, 185; 220/335; 292/87, 86, 80, 91, DIG. 38; 206/425, 45.2, 45.23

[56] References Cited

U.S. PATENT DOCUMENTS

| | | | |
|---|---|---|---|
| Re. 28,927 | 8/1976 | Karper | 312/189 X |
| Re. 30,624 | 5/1981 | Soulakis et al. | 206/425 X |
| 298,450 | 5/1884 | Colton | 312/183 |
| 1,478,762 | 12/1923 | Russell | 312/189 X |
| 1,595,761 | 8/1926 | Doughty | 206/425 |
| 2,809,766 | 10/1957 | Anderson | 292/87 X |
| 2,897,034 | 7/1959 | Kalen | 312/244 X |
| 2,977,113 | 3/1961 | Malin et al. . | |
| 3,602,563 | 8/1971 | Karper | 312/189 |
| 3,604,773 | 9/1971 | Haynes | 312/244 |
| 3,869,045 | 3/1975 | Lear | 312/183 X |
| 4,023,839 | 5/1977 | Bisbing | 292/DIG. 38 |
| 4,249,760 | 2/1981 | Conley | 292/DIG. 38 |
| 4,344,646 | 8/1982 | Michel | 292/DIG. 38 |
| 4,515,419 | 5/1985 | Hampel et al. | 206/45.23 X |

FOREIGN PATENT DOCUMENTS

| | | | |
|---|---|---|---|
| 194551 | 1/1958 | Austria | 292/87 |
| 559383 | 9/1932 | Fed. Rep. of Germany | 220/335 |
| 2202349 | 11/1972 | Fed. Rep. of Germany | 206/425 |
| 2929172 | 2/1981 | Fed. Rep. of Germany | 206/425 |
| 1040140 | 10/1953 | France | 206/45.2 |
| 208460 | 5/1940 | Switzerland | 292/87 |

*Primary Examiner*—Joseph Falk

*Attorney, Agent, or Firm*—Robert E. Burns; Emmanuel J. Lobato

[57] ABSTRACT

A closed portable card file comprises a base, cover, retractable carrying handle and a releasable latch to hold the cover closed. The back of the cover is square and extends down behind the back of the base and is hinged near the bottom of the base so that when the card file is in closed condition the back of the cover is approximately perpendicular to the base and when the card file is open, the back of the cover lies approximately in the plane of the base. Hence the card file can stand upright on the back of the cover when closed. When the card file is open and rests on a horizontal surface, the cover stands upright and is retained in open position by its weight. The base has rails for receiving notched cards and guides, and ribs which are parallel to the rails and are of a height to engage lower edges of the cards and guides and thereby reduce wear on the notches which receive the rails.

20 Claims, 4 Drawing Sheets

CLOSED PORTABLE CARD FILE

FIELD OF INVENTION:

The present invention relates to card files and, in particular, to closed portable card files.

BACKGROUND OF INVENTION:

Card files are widely used for storing information of various kinds. For example, they may be used for storing names, addresses and telephone numbers or for listing products of various kinds. They have the convenience that cards can be inserted and removed so that the stored information can be up-dated and kept current. Card files are available in many sizes and models. Some card files are open while others are provided with a cover so that they can be closed. For the most part, card files are adapted to sit on a desk, table bookcase, file cabinet or other horizontal surface. While they are portable in the general sense of being small enough to be moved about, they are not adapted to be carried conveniently, for example like a briefcase or a piece of luggage.

SUMMARY OF THE INVENTION:

It is an object of the invention to provide a closed type card file which can be used both on a desk and on trips. In accordance with the invention there is provided a closed portable card file having a base provided with rails for holding notched cards and indices, a hinged cover which completely encloses the cards when in closed position, a releasable latch for securely holding the cover closed and a convenient carrying handle which is movable from a retracted position in which it is stored against the base and an extended position for carrying the card file. A feature of the closed portable card file in accordance with the invention is that the rear end of the cover extends down behind the rear end of the base and is hinged near the bottom of the base. The cover has a square rear end which is approximately perpendicular to the bottom of the base when the cover is latched closed so that the card file can stand upright on its rear end. When the card file is place horizontally on a desk or other horizontal surface and the cover is opened, the rear end of the cover is approximately in the same plane as the bottom of the base and rests on the supporting surface to maintain the cover in an upright open position. The hinge by which the cover is attached to the base is concealed inside the cover and the hinge pin is on the inner side of the hinge so that the hinge does not in any way detract from the neat and attractive appearance of the card file.

By reason of a portable card file being repeatedly moved and carried about, the notches in the cards are prone to become worn by their engagement with the rails on which the cards are installed. A further feature of the closed portable card file in accordance with the invention is that the bottom of the base is provided with ribs which are laterally spaced from the rails and engage the lower edges of the cards so that that when the card file is in normal horizontal position, the cards are supported by the ribs thereby reducing wear of the notches which embrace the rails. Preferably there are two rails and three ribs symmetrically positioned. Preferably the rails and ribs are curved in a vertical plane so that they are upwardly convex and their rear ends are higher than their front end.

Except for accessory parts, such as rails, hinges, a latch spring and rivets the closed portable card file in accordance with the present invention is molded of durable, impact-resistant plastic material such as ABS so that it can be economically produced, is extremely durable and is attractive in appearance.

BRIEF DESCRIPTION OF DRAWINGS:

Still other features and advantages of a closed portable card file in accordance with the invention will appear from the following description of a preferred embodiment shown by way of in the drawings in which.

Figure 1:
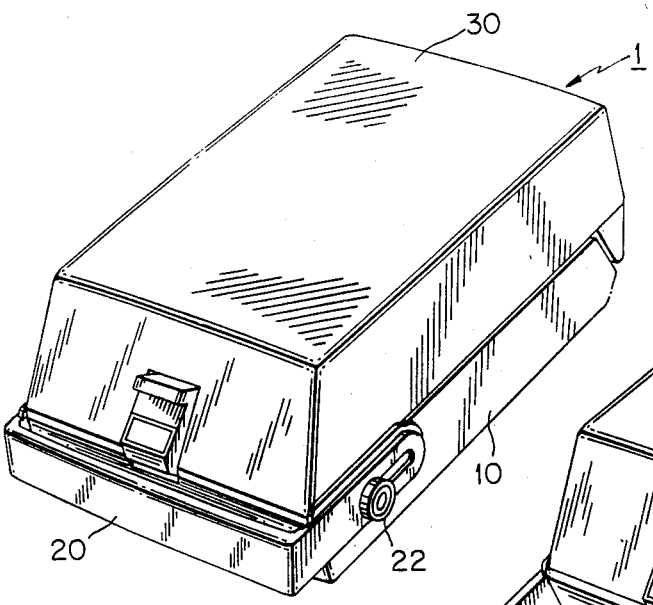
FIG. 1 is a perspective view of a closed portable card file in accordance with the present invention shown with the cover closed and with the carrying handle in retracted position.
Figure 2:
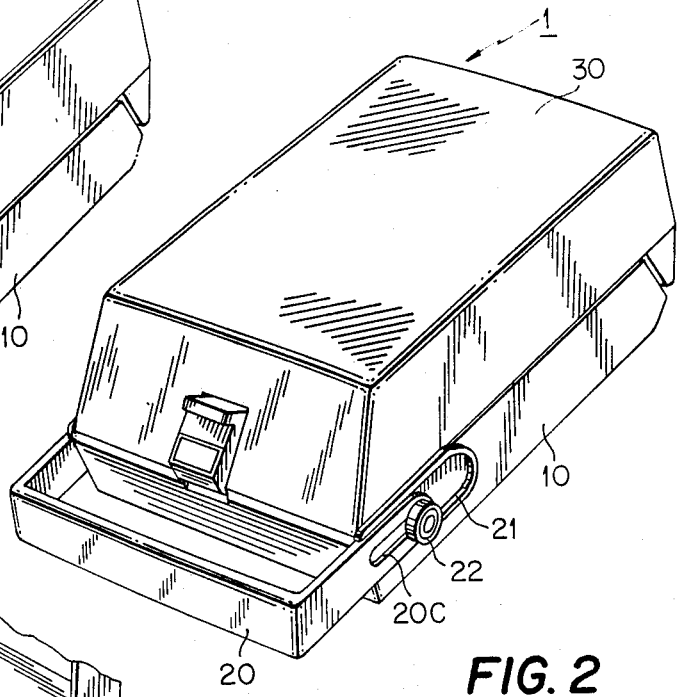
FIG. 2 is a perspective view of the card file with the cover in closed position and the carrying handle extended.
Figure 3A:
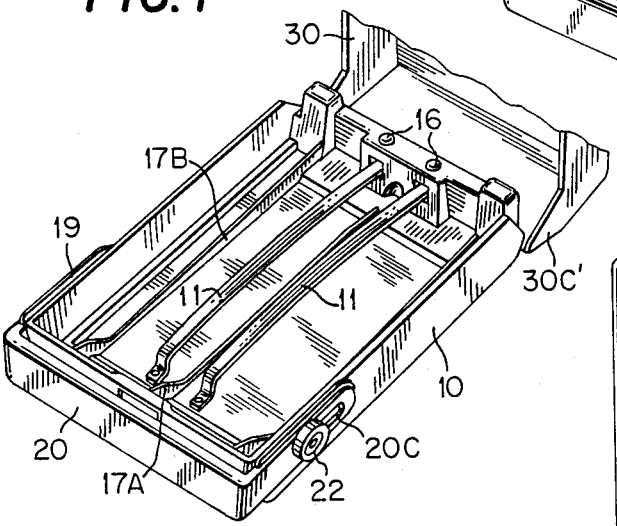
FIG. 3A is a partial perspective view showing the base of the car with cards and guides removed.
Figure 3:
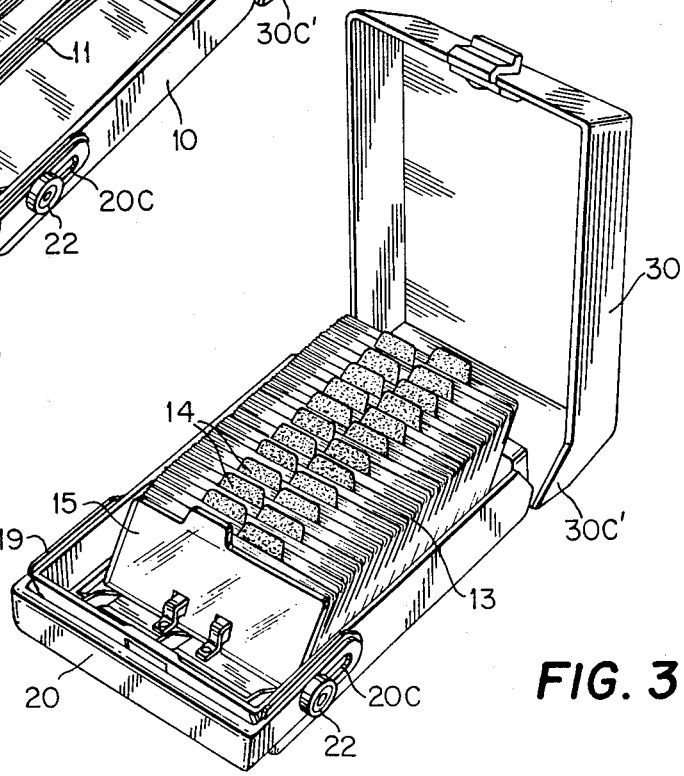
FIG. 3 is a perspective view with the cover in open position.
Figure 4:
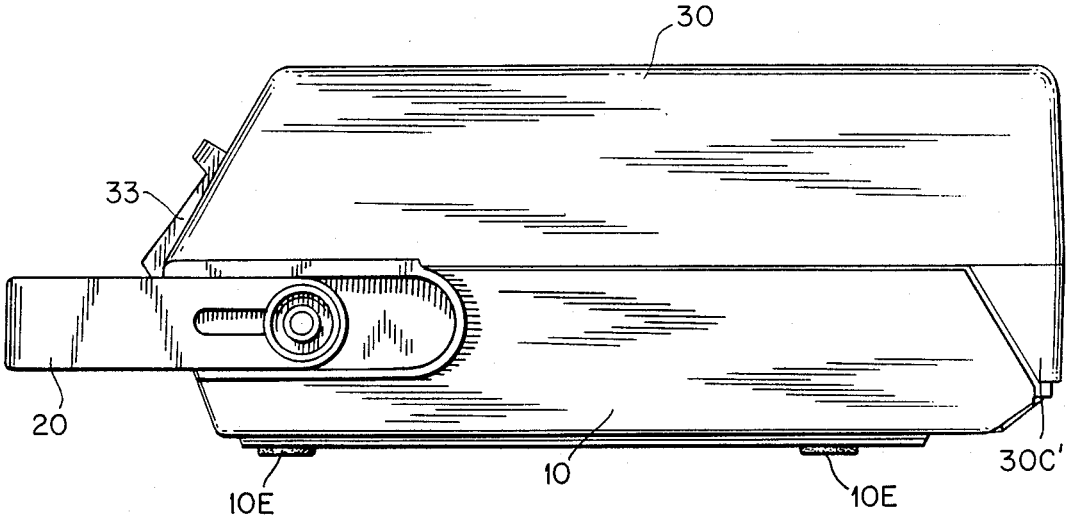
FIG. 4 is a side elevation with the cover in closed position and the carrying handle extended.
Figure 5:
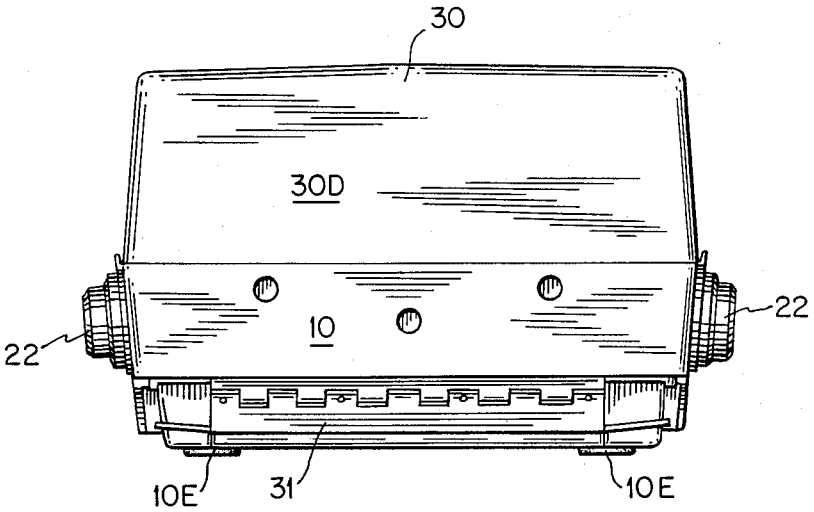
FIG. 5 is a rear elevation with the cover closed.
Figure 6:
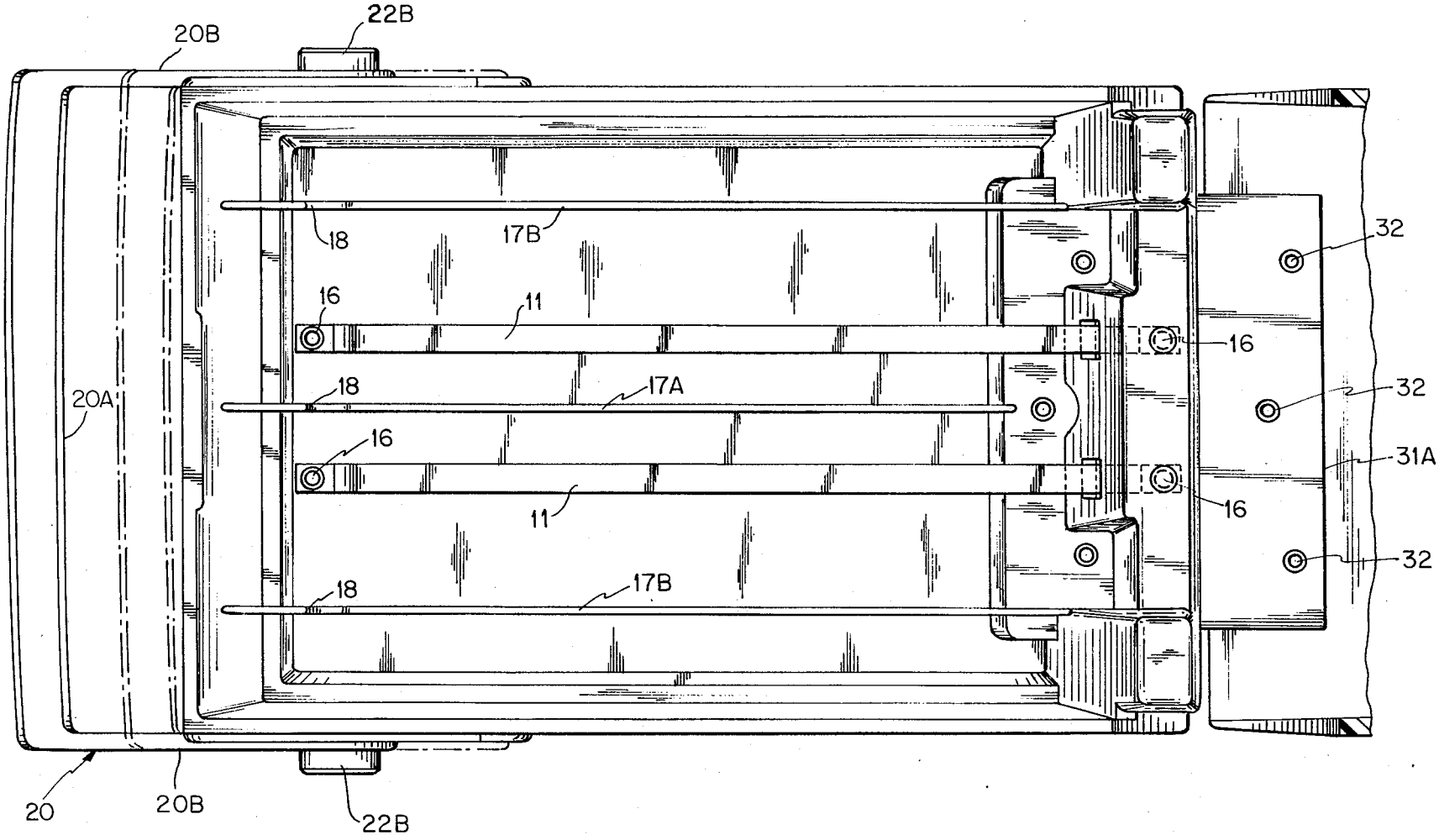
FIG. 6 is a plan view of the base and a portion of the cover with cards and guides removed and with the handle shown in extended position by solid lines and in retracted position in broken lines.

DESCRIPTION OF PREFERRED EMBODIMENT:

A preferred embodiment of a card file 1 shown by way of example in the drawings comprises a base 10 provided with a retractable carrying handle 20 and a hinged cover 30 movable from a closed position as shown in FIGS. 1 and 2 and an open position as shown in FIG. 3.

Figure 7:
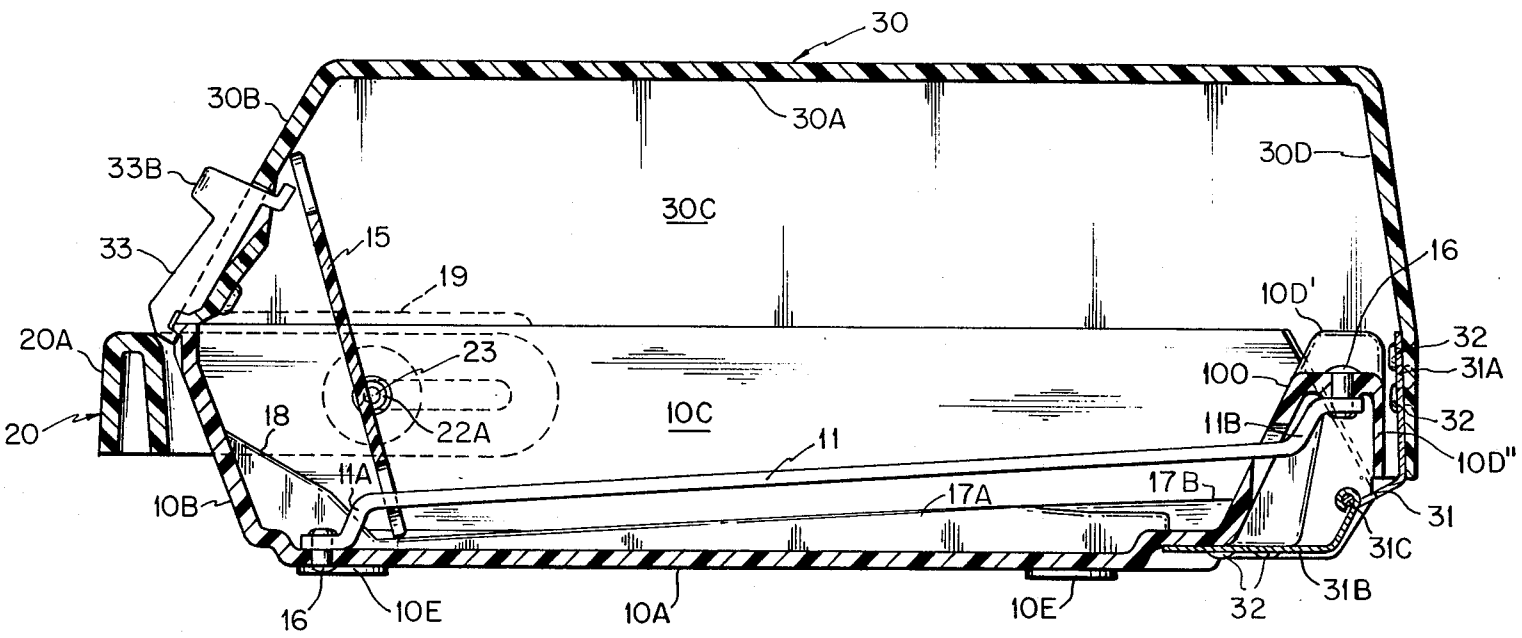
FIG. 7 is a longitudinal section shown with the cover in closed position, the carrying handle retracted and cards and guides removed.

The base 10 comprises a bottom 10A, an upwardly sloping front 10B opposite vertical sides 10C and an upwardly sloping back 10D. As seen in FIG. 7 the back 10D has a rearwardly extending top portion 10D' and a downwardly sloping rear flange portion 10D''. Moreover, the bottom is provided with four feet 10E of elastomeric material.

On the inside of the bottom 10A there are provided two longitudinally extending rails 11 adapted to receive notched cards 13, guides 14 and a clear plastic front plate 15. Forward end portions 11A of the rails 11 are bent downwardly as seen in FIG. 7 and secured to the bottom of the base by rivets 16. Rear end portions 11B of the rails 11 extend through openings in the back 10D and are bent upwardly so as to be secured to the top portion 10D' of the back by rivets 16. As will appear below, the mounting of the rails in this manner avoids interference with the hinge by which the cover is attached to the base.

As will be seen in FIG. 7, the rails 11 are curved in vertical planes so as to be upwardly convex. The radius of curvature is quite long, for example of the order of six feet so that the curvature is slight. Moreover, as also seen in FIG. 7 rear portions of the rails 11 are higher than forward portions so that the rails slope upwardly to the rear. This formation of the rails has been found to facilitate the viewing of cards mounted on the rails.

On the inner side of the bottom 10A of the base, there are provided three longitudinally extending and upwardly projecting ribs, namely a central rib 17A midway between the two rails 11 and two side ribs 17B spaced laterally outwardly of the rails 11. The ribs 17A, 17B are formed integrally with the bottom of the base and are of a height to engage the lower edges of cards and guides assembled on the rails 11. Thus when the card file is in normal horizontal position on a desk or other surface, the cards and guides are supported by the ribs 17A, 17B. This has been found to relieve wear of the notches in the lower edges of the cards and guides by which the cards and guides are retained on the rails. As seen in FIG. 7 the ribs 17A, 17B are curved in vertical planes like the rails 11 and also slope upwardly toward the rear. However, a rear end portion of the central rib 17A is a little lower to avoid cards hanging up on the back of the rib.

It will be noted that the back 10D of the base 10 slopes rearwardly so that when the cards and guides are in the position shown in FIG. 3 they are inclined upwardly toward the rear. Individual cards can thereupon be viewed by tipping forward cards forwardly thus opening up the assembly of cards. At the front of the bottom, there are provided three triangular flanges 18 which slope upwardly from the bottom of the base and join the front 10B. These flanges limit forward movement of the lower edge of the front plate 15 to provide a pivot about which the front plate can tip to a forwardly inclined position against the front 10B of the base or against the cover when the cover is closed as shown in FIG. 7.

On forward portions the sides 10C of the base there are provided upwardly extending side flanges 19 which engage sides of the cover when the cover is in closed position and thereby keep the cover precisely centered in a lateral direction relative to the base.

Carrying handle 20 is mounted on the base 10 so as to be movable from a retracted position as shown in FIG. 1 to an extended operative position as shown in FIG. 2. The handle 20 comprises a grip portion 20A which extends transversely of the base and two side portions 20B which embrace opposite sides of the base. As seen in FIG. 7 the grip portion 20A of the handle is of U-shaped cross section which opens downwardly when the card file is in horizontal position. This provides a strong construction and also makes the handles more comfortable to hold.

Side portions 20B of the handle are received in guide channels formed by parallel projecting ribs 21 on the outer faces of the sides 10C of the base. These ribs guide the handle in its movement between retracted position and extended position and ensure that such movement is rectilinear.

The carrying handle 20 is attached to the base by two knobs or studs 22 secured to opposite sides of the base by rivets 23. They have shank portions 22A which extend through elongated slots 20C in the side portions 20B of the handle and heads 22B which engage outer faces of the sides 20B of the handle. The handle is thereby slidably attached to the base, sliding movement of the handle being limited by the length of the slots 20C. The handle 20 and the studs 22 are of sturdy construction so as to provide adequate strength for carrying the card file and also to resist impact or shock.

The cover 30 comprises a top 30A, a front 30B, opposite sides 30C and a back 30D.

When the cover is in closed position as shown in FIG. 7 the top 30A is approximately parallel to the bottom 10A of the base and the sides 30C lie in the same planes as the sides 10C of the base. The front 30B of the cover slopes downwardly as seen in FIG. 7. This not only provides an attractive appearance, but as will be noted below, is advantageous with respect to operation of a latch for holding the cover in closed position. The back 30D of the cover extends down below the lower edges of the sides 30C and is connected with the sides by triangular flange portions 30C'. The back 30D thus extends down back of the back 100 of the base.

The cover is attached to the base by a hinge 31 having a wing 31A secured to the downwardly extending back 30D of the cover by rivets 32 and a wing portion 31B which is received in a recessed portion at the rear of the bottom 10A of the base and is secured by rivets 32. It will be noted that the wing 31A of the hinge 31 is on the inside of the back 30D of the cover 30 and is thus concealed. Morever the hinge pin 31C is on the inside of the hinge so that it likewise is concealed, thereby providing a smooth and attractive external appearance. By reason of the rear ends of rails 11 being bent upwardly and secured to the top portion of 10D' of the back 10D of the base as described above, the mounting of the rails 11 does not interfere with attachment of the hinge 31 to the base.

When the cover 30 is in closed position, the back 30D of the cover is approximately perpendicular to the top of the cover and the bottom of the base so that the card file can stand in a vertical position on its rear end. By reason of the location of the hinge pin, the back 30D of the cover 30 lies in approximately the same plane as the bottom of the base when the base rests on a horizontal surface and the cover is in open position as shown in FIG. 3. The cover is thus retained in open position by its own weight thereby providing free access to the cards in the file.

Figure 8:
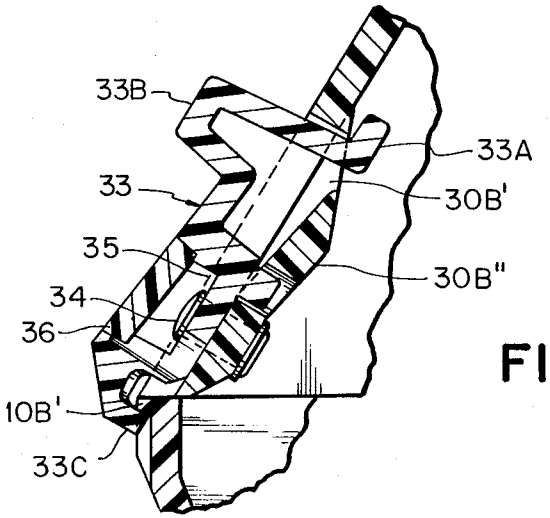
FIG. 8 is an enlarged sectional view showing the latch and adjacent portions of the cover and base.

A latch for holding the cover in closed position comprises a latch member 33 engageable with a lip 10B' at the upper edge of the front 10B of the base. To provide for mounting the latch member 33, the front 30B of the cover is provided with an opening 30B' separated from the lower edge of the cover by a bridge portion 30B'' which, as seen in FIGS. 7 and 8, is recessed and is of arcuate cross section.

An upper portion of the latch member 33 has an inwardly projecting portion 33A which extends through the opening 30B' in the front of the cover. Opposite the projection 33A is an outwardly projecting portion 33B which provides a push-portion for operating the latch to release it. A lower portion 33C of the latch member has an inturned lip which as seen in FIG. 7 and 8 is engagable with the lip 10B' of the base. An intermediate recessed portion of the latch member 33 is secured to the bridge portion 30B'' of the cover by a rivet 34 and a leaf spring 35 which presses the latch portion against the bridge portion 30B'' of the cover. The spring 35 thus biases the latch member to "latched" position as shown in FIG. 8 with the lip portion 33C of the latch member hooked over the lip 10B' of the base to hold the cover in closed position. When pressure is exerted on the push portion 33B the latch member is rocked in a clockwise direction (as viewed in FIG. 8) on the arcuate surface of the bridge portion 30B'' to disengage the lip portion 33C of the latch member from the lip 10B' of the base thereby permitting the cover to be opened. When the cover is closed after having been opened, the lip portion 33C of the latch member engages and rides over the lip 10B' of the base and snaps into latched position as shown in FIG. 8. By reason of the slope of the slope of the front 30B of the cover, the latch member 33 engages the lip 10B' of the base at an angle, thereby facilitating the action of the latch member in riding over the lip 10B' of the base. As will be seen from FIG. 8, a lip on the inward projection 33A of the latch member 33 limits outward movement of the push portion 33B. After the latch member has been installed on the cover as described above a plastic insert 36 is snapped into place to close the recess in which the rivet 34 and spring 35 are located, thereby providing a flush surface with a neat and attractive appearance.

Except for accessory parts such as the rails 11, hinge 31, spring 35 and rivets—which may be of metal—the entire case of the card file is preferably molded of strong impact resistant plastic material such as ABS. Thus the base 10 including the ribs 17A, 17B and flanges 18 constitute one molding while the cover 30, carrying handle 20 and latch member 33 are additional moldings. As illustrated in the drawings, the depth of the base is approximately equal to that of the cover although the cover may be slightly deeper in order to assure adequate clearance for the cards and guides when the cover is in closed position. The use of plastic material contributes to economy of manufacture and to obtaining an attractive product. By use of appropriate dies, outer surfaces of the case can be attractively textured, for example to simulate leather.

While a preferred embodiment of the invention has been illustrated in the drawings and is herein particularly described, it will be understood that various modifications can be made. For example the card files can be made to accommodate different sizes of cards and also different numbers of cards in the file. Thus the invention is in no way limited to the illustrated embodiment.

What is claimed is:

1. A closed portable card file comprising a molded plastic base having a bottom and integral upstanding opposite sides, front and back rigid and said bottom, a molded plastic cover having a top and integral opposite sides, front and back rigid with said top, hinge means connecting said back of said cover to the rear of the bottom of said base for movement of said cover between a closed position and an open position, a U-shaped handle having an elongate grip portion parallel to the front of said base and integral side portions embracing opposite sides of said base, means slidably connecting said side portions of said handle with respective sides of said base for rectilinear sliding movement of said handle from a retracted position in which said grip portion of said handle is against the front of said base and an extended position in which said grip portion of said handle is spaced from the front of said base, latch means on said front of said cover releasably engaging detent means on said front of said base in closed position, laterally spaced rails extending longitudinally on the inside of said bottom and a multiplicity of notched file cards and guides removably installed on said rails with said rails received in notches of said file cards and guides, said file cards and guides being substantially upright when said base is in a horizontal position and said top of said cover being spaced from said bottom of said base when said cover is in closed position a distance greater than the height of said file cards and guides.

2. A closed portable card file according to claim 1, in which the back of said cover extends down below the sides of said cover and behind the back of said base, said hinge means comprising a hinge pin near the bottom of said base, the back of said cover being substantially perpendicular to the bottom of said base when the cover is in closed condition and lying substantially in the plane of said base when the cover is in open condition whereby said card file can stand upright on a horizontal surface when the cover is in closed position and said cover can stand upright when the bottom of said base rests on a horizontal surface and said cover is in open position.

3. A closed portable card file according to claim 2, in which said hinge means comprises a hinge having one wing secured to the inside of the back of said cover and another wing secured to the outside of a recessed portion of the bottom of said base.

4. A closed portable card file according to claim 3, in which said hinge has a hinge pin connecting said wings and disposed on the inside of said hinge, whereby said hinge has a substantially smooth exposed exterior surface.

5. A closed portable card file according to claim 1, in which lower edges of sides and front of said cover abut upper edges of sides and front respectively of said base when said cover is in closed condition, and in which flanges on forward portions of sides of said base engage forward portions of sides of said cover to restrain a front portion of said cover from movement laterally of said base.

6. A closed portable card file according to claim 1, in which forward portions of sides of said base have on their external surfaces longitudinally extending channels receiving said side portions of said handle and thereby guiding said handle in rectilinear movement between retracted position and extended position, said side portions of said handle having longitudinally extending slots, and in which fixed studs projecting laterally from sides of said base have shank portions extending laterally from sides of said base have shank portions extending through said slots in the side portions of said handle and head portions engaging outer surfaces of said side portions of said handle to retain said side portions of said handle in said channels and thereby prevent said handle from pivoting.

7. A closed portable file according to claim 1, in which a central portion of the front of said cover has an opening spaced from the lower edge thereof by an arcuate bridge portion, and in which said latch means comprises a molded member having in an upper portion thereof an inner retaining portion received in said opening and an external push portion, and having in a lower portion thereof an inturned lip adapted to engage said detent means on the front of said base, and spring means resiliently securing an intermediate portion of said member to said bridge portion of the front of said cover.

8. A closed portable card file according to claim 7, in which said spring means comprises a leaf spring and a rivet securing said leaf spring to said bridge portion of the front of said cover.

9. A closed portable card file according to claim 8, in which said molded latch member has an outwardly opening recess in which said leaf spring and rivet are accommodated, and in which a snap-in plate closes said recess after said latch member is installed.

10. A closed portable card file according to claim 7, in which the front of said base is approximately perpendicular to the bottom and the front of said cover on which said molded latch member is mounted in inclined relative to the top of said cover, whereby said latch member meets the front of said base at an obtuse angle.

11. A closed portable card file according to claim 1, in which a plurality of longitudinally extending ribs on the inside of the bottom of said base are spaced laterally from said rails and are engagable with lower edges of cards and guides installed on said rails to support said cards and guides.

12. A closed portable card file according to claim 11, in which there are two of said rails and three of said ribs, with one of said ribs disposed centrally between said rails and two of said ribs disposed laterally outwardly of said rails respectively.

13. A closed portable card file according to claim 11, in which triangular flanges slope upwardly from front ends of said ribs and merge into the front of said base.

14. A closed portable card file according to claim 1, in which said rails are curved convexly upwardly in vertical planes.

15. A closed portable card file according to claim 11, in which said rails and said ribs on the inside of the bottom of said base are curved convexly upwardly in vertical planes.

16. A closed portable card file according to claim 14, in which rear ends of said rails are higher than front ends thereof relative to the bottom of said base.

17. A closed portable card file according to claim 15, in which rear ends of said rails and ribs are higher than front ends thereof relative to the bottom of said base.

18. A closed portable card file according to claim 1, in which front end portions of said rails are bent downwardly and are secured to the bottom of said base, and rear end portions of said rails are bent upwardly and are secured to the back of said base.

19. A closed portable card file according to claim 1, in which a plastic front plate of the size and shape of said cards is notched to receive said rails and in which means is provided for positioning a lower edge of said front plate rearwardly of the front of said base for pivotal movement about its lower edge to an inclined position with an upper portion engaging the front of said base.

20. A card file comprising a base of plastic material having an upper surface, a pair of parallel rails mounted on said base to receive a multiplicity of notched file cards and guides, said rails being disposed over said upper surface of said base, a multiplicity of file cards and guides installed on said rails by having notches in lower edges of said file cards and guides in which said rails are received, and a plurality of upwardly projecting ribs formed integrally on said upper surface of said base, said ribs extending parallel to and being spaced laterally from said rails and projecting up from said upper surface of the base in position to engage lower edges of file cards and guides installed on said rails and thereby cooperate in supporting said cards and guides on said rails with lower edges of said file cards and guides thereby spaced from said upper surface of said base over which said rails are disposed, there being three of said ribs of which one is midway between said rails and two are spaced laterally outwardly of said rails respectively.

* * * * *